US006767878B1

(12) United States Patent
Paye et al.

(10) Patent No.: US 6,767,878 B1
(45) Date of Patent: Jul. 27, 2004

(54) LIGHT DUTY LIQUID CLEANING COMPOSITION WITH SUSPENDED SOLID PARTICLES

(75) Inventors: Marc Paye, Hognoul (BE); Louis Oldenhove, Liege (BE); Christine Toussaint, Aineffe (BE); Karen Wisniewski, Bound Brook, NJ (US); Barbara Thomas, Flemington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/625,163

(22) Filed: Jul. 23, 2003

(51) Int. Cl.[7] ..... C11D 1/83; C11D 3/14; C11D 3/22; C11D 3/37; C11D 17/00

(52) U.S. Cl. ..... 510/221; 510/223; 510/227; 510/228; 510/230; 510/237; 510/470; 510/503

(58) Field of Search ..... 510/221, 223, 510/227, 228, 230, 237, 470, 503

(56) References Cited

U.S. PATENT DOCUMENTS 6,429,180 B1 * 8/2002 Wisniewski et al. ..... 510/218
6,506,719 B1 * 1/2003 Arvanitidou et al. ..... 510/424
6,610,639 B1 * 8/2003 Arvanitidou ..... 510/218

* cited by examiner

*Primary Examiner*—Brian P. Mruk
(74) *Attorney, Agent, or Firm*—Bernard Lieberman

(57) ABSTRACT

A light duty liquid detergent with desirable cleansing properties to the human skin and dishes comprising a $C_{8-18}$ ethoxylated alkyl ether sulfate anionic surfactant, a sulfonate anionic surfactant, an alkyl polyglucoside surfactant, an amine oxide, solid particles, a 3-D structuring agent which is a particles suspending system and water.

4 Claims, No Drawings

LIGHT DUTY LIQUID CLEANING COMPOSITION WITH SUSPENDED SOLID PARTICLES

FIELD OF INVENTION

This invention relates to a light duty liquid cleaning composition which contains solid particles ingredients, a particle suspending system, is mild to the skin and which demonstrates improved sensory attributes when used as a hand soap designed in particular for dishware. Furthermore the exfoliating agents improve grease removal effectiveness.

BACKGROUND OF THE INVENTION

The present invention relates to light duty liquid detergent compositions with high foaming properties, which contains mixtures of anionic surfactants, amine oxide surfactant, alkyl polyglucoside surfactant, soft abrasive or exfoliating particles and a 3-D structuring agents able to suspend the particles in the product.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

U.S. Pat. No. 6,509,306 discloses a light duty liquid detergent with desirable cleansing properties to the human skin and dishes containing a silicone polymer that delivers improved skin feel properties to the hands. U.S. patent application Ser. No. 2003/0,044,442 (Mar. 6, 2003) describes a granular composition for use in a personal care product which comprises at least one water-insoluble inorganic material having a particle size of no more than 50 $\mu$m and up to 10 percent by weight, with perceived exfoliating skin feel. EP-A-670 712 discloses an exfoliating composition including a particulate exfoliating material with a particle size in the range of 0.03 to 3 mm which is friable and under conditions of use of the composition breaks up into particles having an average size of less than 40 $\mu$m.

SUMMARY OF THE INVENTION

It has now been found that a light duty liquid detergent can be formulated with a mixture of anionic surfactants, alkyl polyglucoside, alkyl monoalkanol amide surfactant, a particulates-suspending system, solid particulates with a particle size between 50 and 750 $\mu$m and water, which has desirable cleaning properties, mildness to the skin and improved sensory attributes to the skin. The addition of the solid particles does not incur a detriment to the skin compatibility properties during dishwashing or during hand washing, and actually improves both sensory attributes on hands when used as a hand soap and the grease removal efficacy on dishes.

An object of this invention is to provide a light duty liquid detergent composition which comprises a sulfate surfactant, a sulfonate anionic surfactant, an alkyl polyglucoside surfactant, solid particulates in the range of 50–750 $\mu$m of particle size, a solid particles suspending system and water wherein the composition does not contain an amine, enzyme, propanediol, or an aminopolyphosphate.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The light duty liquid compositions of the instant invention comprises approximately by weight:

(a) 2% to 12%, more preferably 3% to 10% of an alkali metal or ammonium salt of a $C_{8-18}$ ethoxylated alkyl ether sulfate and/or an $C_{8-18}$ alkyl ether sulfate;

(b) 10% to 30%, more preferably 10% to 20% of an alkali metal or alkaline earth metal salt of an anionic sulfonate surfactant;

(c) 0.5% to 10%, more preferably 5% to 10% of an alkyl polyglucoside surfactant;

(d) 0.5% to 10% of at least one solubilizer;

(e) 1% to 12% of an amine oxide surfactant;

(f) 0.1% to 2%, more preferably 0.1% to 1% of Silica-TiO2 particles which functions as a sensory and skin exfoliating signal and a grease removal enhancing agent on dishes;

(g) 0 to 4% of a magnesium inorganic salt;

(h) 0.5% to 5% of a solid particles-suspending system; and (i) the balance being water, wherein the composition does not contain an amine, enzyme, propanediol, or an aminopolyphosphate.

The instant compositions do not contain an N-alkyl aldonamide, choline chloride or buffering system which is a nitrogerious buffer which is ammonium or alkaline earth carbonate, guanidine derivates, alkoxylalkyl amines, alkyleneamines, $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel.

The anionic sulfonate surfactants which may be used in the instant composition of this invention are water soluble and include the magnesium sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The amine oxide semi-polar nonionic surfactants used in the instant compositions comprise compounds and mixtures of compounds having the formula

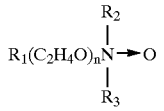

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

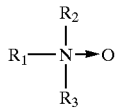

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The alkyl polysaccharides surfactants, which are used in conjunction with the aforementioned surfactants have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=1 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The water is present in the composition at a concentration of 5 wt. % to 65 wt. %.

The cleaning composition contains at least one solubilizer selected from the group consisting of a $C_2$–$C_5$ mono, dihydroxy or polyhydroxy alkanols such as ethanol, isopropanol, glycerol, ethylene glycol, diethylene glycol, propylene glycol, and hexylene glycol and mixtures thereof, urea, and alkali metal salts of cumene, toluene or xylene sulfonates such as sodium cumene sulfonate and sodium xylene sulfonate and mixtures thereof.

The solid particles suspended in the instant composition are a mixture of silica and titanium dioxide. An especially preferred Silica/TiO2 mixture (weight ratio 18:1) is manufactured by Ineos Silicas as Neosil PC20S. Silica is of amorphous type. As alternatives, other solid particles of a size in the range of 50 to 750 μm may be used, like Polyethylene beads or Apricot seed powder.

Polyethylene beads are butylene/ethylene copolymers of a particle size ranging from 50 to 350 μm with a preference being above 100 μm. Density at 20° C. is between 0.94 and 0.97. An especially preferred Polyethylene powder is supplied by Billeter AG as Abifor 1300/20.

Apricot seed powder is derived from *Prunus Armeniaca*; they are particulates with a density between 0.45 and 0.8 and a size between 50 and 500 μm. An especially preferred supplier is Alban Muller and preferred particle size between 200 and 300 μm.

The 3-D structuring agent which is the solid particles-suspending system is preferably a polyacrylate. One acrylate aqueous solution used to form a 3D-system and to allow a stable suspension of the solid particles is manufactured by Noveon as Carbopol Aqua 30.

The Carbopol resins, also known as "Carbomer," are hydrophilic high molecular weight, crosslinked acrylic acid polymers having an average equivalent weight of 76, and the general structure illustrated by the following formula:

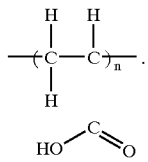

Carbopol 941 has a molecular weight of about 1,250,000; Carbopol 940 a molecular weight of approximately 4,000,000 and Carbopol 934 a molecular weight of approximately 3,000,000. The Carbopol resins are crosslinked with polyalkenyl polyether, e.g. about 1% of a polyalkyl ether of sucrose having an average of about 5,8 alkyl groups for each molecule of sucrose. Further detailed information on the Carbopol resins is available from B. F. Goodrich, see, for example, the B. F. Goodrich catalog GC-67, Carbopol® Water Soluble Resins.

Other systems able to suspend solid particles may be used as alternatives. Among others, some potentially thickening systems can be selected in:

Polymers such as polyacrylates (linear or cross-linked), cellulose ethers (eg those derived from hydroxyethyl or hydroxypropyl cellulose), natural polysaccharides and gums (eg Carrageenan, Xanthan, etc);

Associative thickeners (eg hydrophobically modified modified polymers);

Inorganic thickeners (eg clay, laponite, etc)

Self thickened surfactant systems (eg containing alcohol ethoxy sulfates and/or betaines and/or amine oxides, etc., with or without salting out agent)

The magnesium inorganic salt used in the instant composition is selected from the group consisting of magnesium oxide, magnesium chloride, and magnesium sulfate hepta hydrate and mixtures thereof.

The instant cleaning compositions explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive cleaning compositions is water. The proportion of water in the compositions generally is in the range of 35% to 90%, preferably 50% to 85% by weight of the cleaning composition.

The liquid cleaning composition of this invention may, if desired, also contain other components either to provide additional effect or to make the product more attractive to the consumer. The following are mentioned by way of example: Colors or dyes or perfumes in amounts up to 1.0% by weight; sodium bisulfite in amounts up to 0.2%, and pH adjusting agents, such as sulfuric acid or sodium hydroxide, as needed. Furthermore, if opaque compositions are desired, up to 4% by weight of an opacifier may be added. Other ingredients in amounts up to 5 wt. % are ethylene diamine tetraacetic acid sodium salt, and hydroxy ethylene diamine tetraacetic acid sodium salt.

Preservatives can be optionally used in the instant compositions at a concentration of 0.005 wt. % to 3 wt. %, more preferably 0.01 wt. % to 2.5 wt. %. These preservatives are: benzalkonium chloride; formalin, benzethonium chloride, 5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N'-(hydroxy methyl)urea; 1-3-dimethyol-5,5-dimethyl hydantoin; formaldehyde; iodopropynl butyl carbamata, butyl paraben; ethyl paraben; methyl paraben; propyl paraben, mixture of methyl isothiazolinone/methylchloroisothiazoline in a 1:3 wt. ratio; mixture of phenoxythanol/butyl paraben/methyl paraben/propylparaben; 2-phenoxyethanol; tris-hydroxyethylhexahydrotriazine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadamantane chloride; and sodium benzoate.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following reference compositions in wt. % were prepared by simple mixing procedure through gentle stirring (100–200 rpm) to avoid air bubble capture. After pH adjustment, products are centrifuged to remove any incorporated air bubbles, and solid particles of Silica/TiO2 are then gently incorporated with slow (50–100 rpm) stirring.

| | A | B |
|---|---|---|
| Carbopol Aqua 30 | 2.5 | 2.5 |
| Water | 10 | 10 |
| Linear alkyl benzene sulfonate sodium salt | 3 | 2.6 |
| $NH_4$ $C_{13-14}$ AEOS 2:1 EO | 11.6 | 10 |
| Linear alkyl benzene sulfonate Mg salt | 9 | 8.7 |
| Lauryl myristylamido propyl dimethyl amine oxide | 5.5 | 4.7 |
| APG 625 | 10.0 | 8.7 |
| Neosil PC2OS (Silica/TiO2 powder) | 0.5 | 0.5 |
| Water | Bal. | Bal. |
| pH | 6.5–7.0 | 6.5–7.0 |
| Viscosity (Brookfield viscometer at 25C, spindle 5, 20 RPMS) cps | 4500 | 8500 |

In final form, the instant composition, as shown in Example 2, exhibits stability at ambient temperatures. More specifically, such a composition as in example 2 remains clear and stable in the range of 15° C. to 35° C., especially 20° C. to 30° C. The liquid cleaning compositions are highly viscous but pourable and exhibit a viscosity in the range of 4000–9000 centipoise (cps) as measured at 25° C. with a Brookfield RVT Viscometer using a # 5 spindle rotating at 20 RPM.

Formula A demonstrated excellent skin compatibility, specific sensory signals with a.o. perception of the exfoliating particles during hand washing, and good dish cleaning performance.

Neosil PC20S is a mixture of solid particulates containing 90% of amophous silica and 5% of Titanium dioxide, supplied by Ineos Silicas. The powder is gently and homogeneously incorporated in the product at the end of the process.

What is claimed:

1. A clear light duty liquid dishwashing composition with suspended particles which comprises approximately by weight:

(a) 2% to 12% of an alkali metal or ammonium salt of a $C_{8-18}$ ethoxylated alkyl ether sulfate and/or a $C_{8-18}$ alkyl sulfate;

(b) 10% to 30% of an alkaline earth metal or alkali metal salt of an anionic $C_9$–$C_{18}$ alkyl benzene sulfonate surfactant;

(c) 0.5% to 10% of an alkyl polyglucoside surfactant;

(d) 0 to 10% of at least one solubilizer;

(e) 1% to 12% of an amine oxide;

(f) 0.1% to 2% of solid particles of a particle size ranging between 50 and 750 $\mu$m;

(g) 0.5% to 5% of a 3-D structurizing agent; and (h) the balance being water.

2. The composition of claim 1, wherein said at least one solubilizer is selected from the group consisting of sodium, potassium, ammonium salts of cumene, xylene, toluene sulfonates, isopropanol, ethanol, glycerol, ethylene glycol, diethylene glycol and propylene glycol and mixtures thereof.

3. The composition of claim 1, wherein said solubilizer is sodium xylene sulfonate and ethanol.

4. The composition of claim 2, further including a magnesium inorganic acid.

* * * * *